United States Patent [19]

Tokushima et al.

[11] Patent Number: 4,589,396

[45] Date of Patent: May 20, 1986

[54] SUPERCHARGER CONTROL IN AUTOMOBILE ENGINE SYSTEM

[75] Inventors: Takashige Tokushima, Higashihiroshima; Kingo Okitsu, Hiroshima; Yoshiyuki Mochizuki, Hiroshima; Kouji Tsuji, Hiroshima, all of Japan

[73] Assignee: Mazda Motor Corporation, Hiroshima, Japan

[21] Appl. No.: 755,721

[22] Filed: Jul. 17, 1985

[30] Foreign Application Priority Data

Jul. 20, 1984 [JP] Japan ..... 59-151837
Jul. 20, 1984 [JP] Japan ..... 59-151836

[51] Int. Cl.[4] ..... F02D 23/00
[52] U.S. Cl. ..... 123/559; 123/564
[58] Field of Search ..... 123/559, 564

[56] References Cited

U.S. PATENT DOCUMENTS 4,527,534 7/1985 Sakurai ..... 123/432

FOREIGN PATENT DOCUMENTS 28044 2/1984 Japan ..... 123/559

*Primary Examiner*—Douglas Hart
*Attorney, Agent, or Firm*—Burns, Doane, Swecker & Mathis

[57] ABSTRACT

A supercharger control in an automobile engine comprising an intake passage having an air pump for supercharging air to be fed to the engine, a bypass passage bypassing the air pump and having a control valve for opening and closing the bypass passage, an electromagnetic clutch for selectively coupling and decoupling the air pump with and from an output shaft of the engine, and a control device for controlling both the air pump and the control valve in dependence on the degree of requirement for acceleration represented by the load on the engine or the position of an automobile transmission.

9 Claims, 11 Drawing Figures

SUPERCHARGER CONTROL IN AUTOMOBILE ENGINE SYSTEM

BACKGROUND OF THE INVENTION

The present invention generally relates to a supercharger control in an automobile engine system and, more particularly, to a control system for controlling an engine-driven, supercharging pump used in association with an automobile engine.

When it comes to the supercharged automobile engine system, two types are generally well known in the art depending on the type of supercharger; one using the turbosupercharger or, simply, turbocharger, driven by the flow of exhaust gases, and the other using a compressor or air pump driven by either an engine or an electric motor. The present invention pertains to the use of the air pump as a source of supercharged air to be supplied to the engine.

A supercharged automobile engine system using an engine-driven air pump, so far considered pertinent to the present invention, is disclosed in, for example, Japanese Laid-open Patent Publication Nos. 58-30414 and 58-30415, both published Feb. 22, 1983. In publication No. 58-30414, an air intake passage extending from an air cleaner to an engine cylinder has an engine-driven, vane-type air pump and a throttle valve installed on upstream and downstream sides, respectively, with respect to the direction of flow of air towards the engine cylinder, and a bypass passage bypassing only the air pump and a control valve installed therein for selective opening and closure of the bypass passage. The air pump used therein is drivingly coupled with the engine through an electromagnetic clutch for selectively coupling and decoupling the air pump with and from the engine, respectively. Both the throttle valve and the control valve are operatively coupled with an accelerator pedal through a mechanical linkage system and are controlled in an opposite sense to each other.

Publication No. 58-30414 makes use of an electromechanical supercharger control connected physically with a link system between the accelerator pedal and the control valve on the one hand, and electrically with the electromagnetic clutch on the other hand. The supercharger control disclosed therein is so designed and so operable that, when the throttle valve being moved from a substantially closed position towards a fully open position as a result of the displacement of the accelerator pedal from a released position towards a fully depressed position attains a first predetermined opening, he clutch can be energized, and kept energized, to couple the air pump with the engine to effect the supply of the supercharged air, but when the throttle valve once having attained the first predetermined opening attains a second predetermined opening smaller than the first predetermined value as a result of the displacement of the accelerator pedal back towards the released position, the clutch can be deenergized to decouple the air pump from the engine to interrupt the supply of the supercharged air.

On the other hand, the control valve in the bypass passage normally held in a fully open position when the throttle valve is in the substantially closed position can be brought to a completely closed position for interrupting the flow of air through the bypass passage, but directing it towards the air pump, subsequent to the start of operation of the air pump, i.e., when and after the throttle valve being moved towards the fully open position has exceeded a third predetermined opening greater than any one of the first and second predetermined values.

The supercharger control is shown and described as including a rotatably supported disc plate having different peripheral portions operatively coupled respectively with the accelerator pedal and the control valve, and two self-energizing circuits operatively associated with each other, one of said self-energizing circuits including two series-connected switches adapted to be successively actuated by a common actuator pin carried by the disc plate.

As acknowledged in publication No. 58-30415, the system of publication No. 58-30414, although effective to operate the air pump to provide the supercharged air when the automobile is desired to be accelerated from a moderate or high speed drive, has a problem in that it cannot be accelerated as desired immediately after the start of the automobile and from a low speed drive because under these circumstances the accelerator pedal is not, and has not yet been, depressed enough to cause the throttle opening to exceed the first predetermined value. More specifically, even though a condition is established wherein a rapid acceleration is desired to be achieved (i.e., wherein the degree of requirement for acceleration is great and the air pump is desired to be operated to quickly increase the engine output torque while the engine is operating under a low load range), the air pump cannot be operated before a high load range is established particularly where the load on the engine at which the air pump starts its operation is set at a relatively high value. Alternatively, where the load on the engine at which the air pump starts its operation is set at a relatively low value, even though a condition is established wherein a moderate acceleration is desired to be achieved (i.e., wherein the degree of requirement for acceleration is small and the air pump is desired to be operated while the engine is operated under a relatively high load range), the air pump tends to be operated, while the engine is operating under a low load range, resulting in the unduly rapid acceleration.

In view of the foregoing, publication No. 58-30415 discloses an improved version which may be considered a combination with the supercharge control of publication No. 58-30414 of another supercharge control operable only when a gear shift lever is in any one of first and second gear positions in view of the fact that acceleration is particularly required when the automobile transmission is set in a low speed range such as first or second gear position. In other words, publication No. 58-30415 assumes that at the start of the automobile the transmission is usually set in the first or second gear position, and starting from this assumption, the use of such another supercharger control has been made together with a microswitch capable of generating an energizing signal to the electromagnetic clutch in response to the setting of the transmission in the low speed range. In one form of the control of publication No. 58-30415, the use is made of an additional control valve disposed in the bypass passage and adapted to be controlled by an electromagnetic actuator energizeable in response to, or a predetermined delay time (necessitated to avoid any possible surging of the air pump) after, the generation of the energizing signal to interrupt the flow of air through the bypass passage. However, in another form of the same control, the control valve of publication No. 58-30414 is utilized also for interrupting the flow of air through the bypass passage during the setting of the transmission in the low speed range, and for this purpose, a unique mechanical linkage is used to connect the control valve with the accelerator pedal on the one hand and with the electromagnetic actuator on the other hand.

Under those circumstances which have been discussed in both of these publications, the supercharger control is so designed according to the second mentioned publication No. 58-30415 as to operate the air pump not only during the setting of the transmission in the low speed range, but also during the moderate or high speed operating condition of the engine appears to be satisfactory. However, in view of the fat that, once the transmission has been set in the low speed range, the supply of the supercharged air takes place regardless of the operating condition then assumed by the engine, some problems have been found. For example, the air pump tends to be operated to eventually increase the engine power output even during a low speed, low load operating condition, which often occurs during a low speed cruising (that is, where the degree of requirement for acceleration is small), and therefore, the engine power output cannot be adequately adjusted without any difficulty. Moreover, during the descent of the automobile down the slope with the transmission set in the first gear position, it may happen that the engine braking will not work and the automobile will run wayward beyond the driver's control.

SUMMARY OF THE INVENTION

Accordingly, the present invention has been developed with a view to substantially eliminating the above discussed problems inherent in the prior art supercharger control systems and has for its essential object to provide an improved supercharger control system, wherein a predetermined load which is imposed on the engine at the time the air pump is to be operated (which load is hereinafter referred to as "pump operating load"), is rendered variable according to the degree of requirement for acceleration rendered at the will of the driver, thereby to eventually improve the accelerating characteristic.

Another important object of the present invention is to provide an improved supercharger control system of the type referred to above, which enables the automobile engine to give an engine power output adequate to the setting of the transmission.

In order to accomplish these objects of the present invention, a supercharger control comprising an air pump disposed in the intake passage and adapted to be controlled in dependence on the load on the engine, a bypass passage bypassing the air pump and a control valve disposed in the bypass passage for selectively opening and closing the bypass passage in dependence on the load on the engine, is provided with a degree detecting means for detecting the degree of requirement for acceleration, and means for varying the pump operating load according to the degree of requirement for acceleration, wherefore the pump operating load in the case where the degree of requirement for acceleration is great can be rendered lower than that in the case where the degree of requirement for acceleration is small.

With this arrangement, during the rapidly accelerated drive at which time the degree of requirement for acceleration is great, the air pump can be operated while the pump operating load is relatively low, to quickly increase the engine output torque. On the other hand, during the moderately accelerated drive, the air pump can be operated while the pump operating load is relatively high, thereby to moderately increase the engine output torque.

In an embodiment of the present invention, the means for detecting the degree of requirement for acceleration is constituted by a detector for detecting, and generating a signal indicative of, the situation in which the accelerator pedal is rapidly depressed. However, in another embodiment of the present invention, the means for detecting the degree of requirement for acceleration is constituted by a detector for detecting, and generating a signal indicative of, the position of the automobile transmission.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
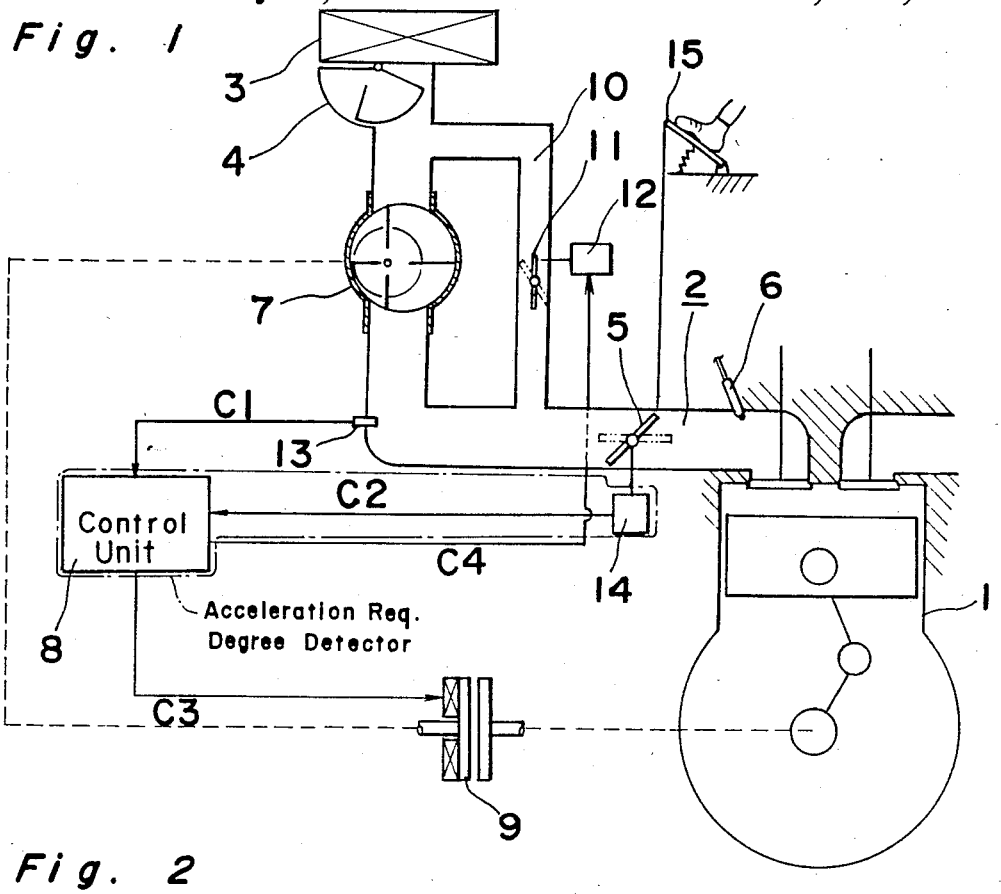
FIG. 1 is a schematic diagram showing a fuel intake system of an automobile engine having a supercharger control according to one embodiment of the present invention.

Before the description of the present invention proceeds, it is to be noted that like parts are designated by like reference numerals throughout the accompanying drawings.

Referring first to FIG. 1, there is schematically shown an automobile engine 1 having an intake passage 2 extending therefrom to an air cleaner 3 in communication with the atmosphere. One end of the intake passage 2 adjacent the air cleaner 3 has an air flowmeter 4 installed therein for metering the flow of air towards the engine 1, whereas the other end of the intake passage 2 adjacent the engine 1 has a throttle valve 5 and a fuel injection nozzle 6 disposed therein on upstream and downstream sides, respectively, with respect to the direction of flow of the air towards the engine 1. A portion of the intake passage 2 between the air flowmeter 4 and the throttle valve 5 has an engine-driven air pump 7 installed therein for supercharging the air flowing through the intake passage 2, and drivingly coupled with an engine power output shaft of the engine through an electromagnetic clutch 9 capable of assuming one of the two opposite, coupling and decoupling positions.

A bypass passage 10 bypassing the air pump 7 has one end communicated with a portion of the intake passage 2 between the air flowmeter 4 and the air pump 7 and the other end communicated with another portion of the intake passage 2 between the air pump 7 and the throttle valve 5. This bypass passage 10 has a control valve 11 installed therein for selectively closing and opening the bypass passage in a manner as will be described later.

As shown, the throttle valve 5 is operatively linked with an accelerator pedal 15 which is normally urged to a released position, at which the throttle valve 5 is held in a substantially closed position shown by the solid line, but can be depressed to a depressed position at which the throttle valve 5 is held in a fully open position shown by the phantom line.

Except for the control valve 11 not linked with the accelerator pedal 15, the engine system so far described may be identical with that disclosed in any one of the previously discussed prior art publications and is, therefore, well known to those skilled in the art.

In the practice of the present invention, the position of the control valve 11 in the bypass passage 10 can be adjusted by a stepper motor 12 operable in response to a drive signal C4 fed thereto from a control unit 8, and the position of the throttle valve 5 can be detected by a throttle sensor 14 capable of generating to the control unit 8 a throttle signal (load signal) C2 indicative of the throttle opening, i.e., the opening of the throttle valve 5.

The control unit 8 is operable in response to a pressure signal C1, fed from a pressure sensor 13 for detecting the pressure inside the intake passage 2 downstream of the air pump 7, and the throttle signal C2 to apply a clutch signal C3 and the drive signal C4 to the electromagnetic clutch 9 and the stepper motor 12, respectively, thereby controlling the air pump 7 and the control valve 11 so that the mode of operation of the engine 1 can be switched between supercharged and non-supercharged modes according to the load imposed on the engine 1. In other words, the control unit 8 is so designed that the engine 1 can operate under the supercharged mode with the air pump 7 driven and with the control valve 11 closing the bypass passage 10 during a high load operating condition of the engine (represented by a hatched region a in FIG. 4(*a*), a hatched region b in FIG. 4(*b*), or a hatched region c in FIG. 4(*c*)), but the engine 1 can operate under the non-supercharged mode with the air pump held still and with the control valve opening the bypass passage 10 during a low load operating condition of the engine (represented by a region other than that shown by a, b or c in FIGS. 4(*a*), 4(*b*) or 4(*c*)). In each of FIGS. 4(*a*) to 4(*c*), a curve shown by Lo represents the maximum torque given by the engine 1.

It is to be noted that, other than as the load signal referred to above, the throttle signal C2 outputted from the throttle sensor 14 may also be utilized as a throttle opening speed signal, i.e., a signal indicative of the speed of opening of the throttle valve 5 (that is, a signal indicative of the degree of requirement for acceleration, or simply, an acceleration requirement signal). Based on this throttle opening speed signal, both the pump operating load, at which the air pump 7 is caused to operate, and the timing at which the control valve selectively opens and closes the bypass passage are changed appropriately. In any event, the throttle sensor 14 and the control unit 8 altogether constitute means for varying the pump operating load.

Hereinafter, respective operating characteristics of the air pump 7 and the control valve 11 will now be described in association with the throttle opening speed. While both the air pump 7 and the control valve 11 are controlled in dependence on the load on the engine 1 and the degree of requirement for acceleration, they are, particularly in the embodiment of the present invention, controlled according to the graph of FIG. 2 in a manner as will be described subsequently.

Figure 2:
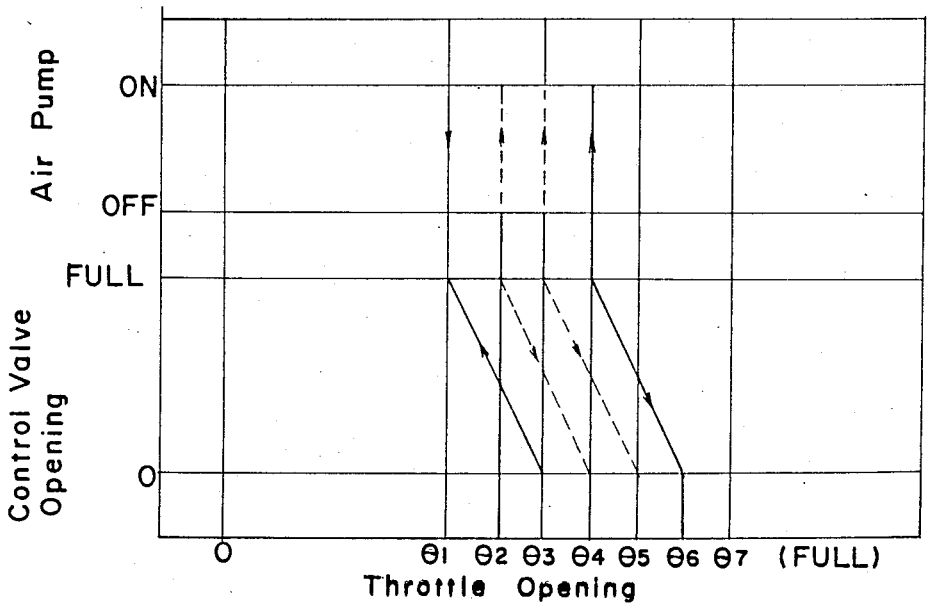
FIG. 2 is a graph showing the operating characteristics of an air pump and a control valve, respectively, shown in timed relation to each other.
Figure 4A:
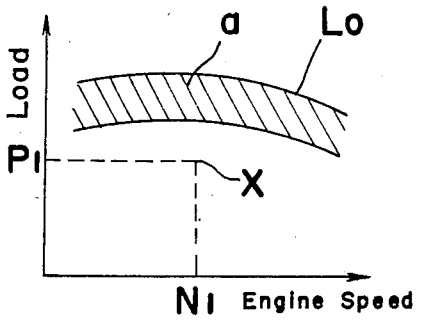
FIGS. 4(*a*) to 4(*c*) are graphs showing different operating ranges.
Figure 4B:
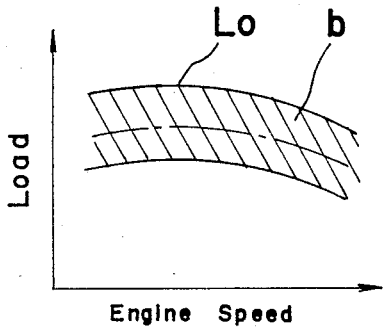
Figure 4C:
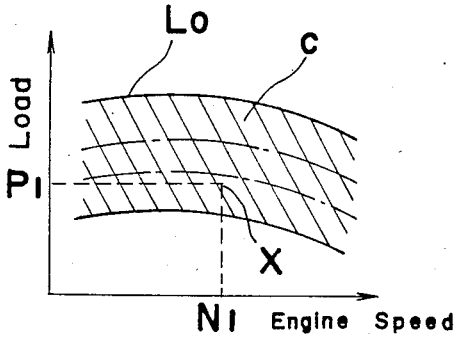

Referring to FIG. 2, the throttle opening speed, that is, the throttle opening corresponding to the pump operating load (that is, the load which is imposed on the engine at the time the air pump is to be operated), may take one of the three values according to the degree of requirement for acceleration. In other words, at the time of a constant speed drive wherein the degree of requirement for acceleration is minimal, the air pump 7 is brought into operation when the throttle opening has been increased to a value $\theta_4$. Accordingly, during the constant speed drive, the supercharged mode of operation of the engine takes place in the operating region as shown in FIG. 4(*a*).

At the time of moderately accelerated drive wherein the degree of requirement for acceleration is moderate, the air pump 7 is brought into operation when the throttle opening has been increased to a value $\theta_3$ smaller than the throttle opening $\theta_4$ referred to above. Accordingly, during the moderately accelerated drive, the supercharged mode takes place in the operating region b shown in FIG. 4(*b*), and it will be readily seen that the supply of the supercharged air to the engine 1 is effected at a lower load engine operating condition than that established during the constant speed drive. Therefore, as compared with the accelerability achieved during the constant speed drive, the accelerability (the set-up of the engine torque, that is, the response to acceleration) can be improved favorably.

At the time of rapidly accelerated drive, the air pump 7 is brought into operation when the throttle opening has been increased to the value $\theta_3$ referred to above. Accordingly, during the rapidly accelerated drive, the supercharged mode takes place in the operating region c shown in FIG. 4(*c*), and it will be readily seen that the supply of the supercharged air to the engine 1 is effected at a lower load engine operating condition than that established during th moderately accelerated drive, with the accelerability consequently improved further as compared with that exhibited during the moderately accelerated drive.

Thus, by designing the pump operating load to be controlled according to the degree of requirement for acceleration in the manner as hereinabove described, the acceleration that agrees with the driver's desire to accelerate can be achieved substantially regardless of the engine operation in any one of the operating regions and, therefore, the running performance of the automobile can be improved. By way of example, when the accelerator pedal 15 is rapidly depressed fully to the depressed position during the constant speed drive with the engine loaded as shown by a load position X (Load:

$P_1$, and Engine Speed: $N_1$) shown in FIG. 4(*a*) (that is, when the degree of requirement for acceleration is minimized), the region in which the engine operates under the supercharged mode shifts from the operating region a shown in FIG. 4(*a*) to the operating region c shown in FIG. 4(*c*) with the load position X consequently included within the region in which the engine now operates under the supercharged mode, and therefore, the supercharging of the air flowing through the intake passage 2 takes place immediately with the automobile accelerated quickly.

On the other hand, the throttle opening corresponding to the load at which the air pump 7 being operating is brought to a halt is fixed to a value $\theta_1$ smaller than the throttle opening $\theta_2$ corresponding to the pump operating load attained at the time of rapidly accelerated drive. thus, since the loads at which the air pump 7 being operated is brought to a halt and that at which the air pump 7 is brought into operation are differentiated from each other regardless of the degree of requirement for acceleration, any possible occurrence of surging of the air pump 7 can be substantially avoided.

With respect to the control valve 11, although a predetermined valve opening load at which the control valve 11 starts opening is fixed to a value corresponding to the throttle opening $\theta_3$ (that is, although the control valve 11 operates in such a manner as to start its opening when the throttle opening is reduced to the value $\theta_3$ and attain a fully open position when the throttle opening is further reduced to the value $\theta_1$), a predetermined valve closing load at which the control valve 11 starts closing may take one of the three values as shown in FIG. 2. In other words, at the time of the constant speed drive wherein the degree of requirement for acceleration is minimal, the control valve 11 starts moving from a fully open position towards a closed position when the throttle opening is increase to the value $\theta_4$, and arrives at the closed position when the throttle opening is further increased to a value $\theta_6$. At the time of the moderately accelerated drive, the control valve 11 starts moving from the fully open position towards the closed position when the throttle opening is increased to the value $\theta_3$, and arrives at the closed position when the throttle opening is further increased to a value $\theta_5$. Furthermore, at the time of the rapidly accelerated drive, the control valve 11 starts moving from the fully open position towards the closed position when the throttle opening is increased to the value $\theta_2$, and arrives at the closed position when the throttle opening is further increased to the value $\theta_4$.

The control valve 11 is so designed that, during the throttle valve 5 being moved from the substantially closed position towards the fully open position, the control valve 11 can progressively close the bypass passage 10 subsequent to the start of operation of the air pump 7 regardless of the degree of requirement for acceleration, but during the throttle valve 5 being moved towards the substantially closed position, the control valve 11 can start opening the bypass passage 10 at a higher load operating condition than that at which the air pump 7 is brought to a halt. Therefore, any possible abrupt change in suction air pressure which would occur at the time the air pump 7 is brought into operation and also at the time the air pump 7 is brought to a halt can advantageously be avoided, thereby minimizing the occurrence of undesirable shock resulting from abrupt change in torque. More specifically, since at the time of start of the operation of the air pump 7 the control valve 11 will not close the bypass passage 10 immediately after the start of the supercharging of the air as a result of the operation of the air pump 7, a portion of the suction air supercharged by the air pump 7 can be relived through the bypass passage 10 back to the upstream side of the air pump 7, allowing the suction air to progressively increase in its pressure. On the other hand, at the time the air pump 7 is brought to a halt, the supercharging of the suction air performed by the air pump 7 is progressively interrupted with the closure of the control valve 11, and therefore no abrupt change in suction air pressure occurs at the time the air pump 7 is brought to a halt.

The control of the air pump 7 according to the degree of requirement for acceleration detected from the opening speed of the throttle valve 5 will now be described with reference to the flowchart of FIG. 3.

Figure 3:
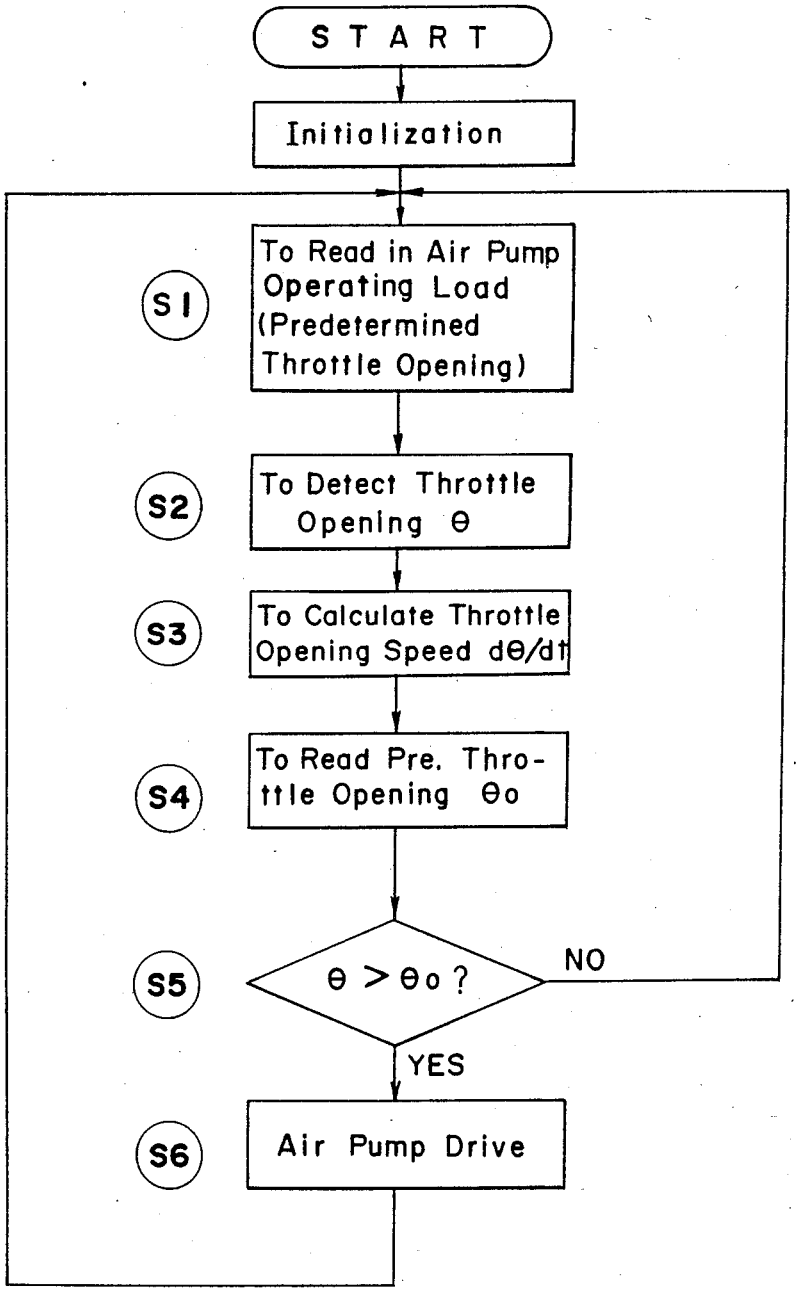
FIG. 3 is a flowchart showing the sequence of programmed control performed by the supercharger control shown in FIG. 1.

Referring to FIG. 3, and subsequent to the initialization, the pump operating load (the throttle opening $\theta_0$) corresponding to the throttle opening speed is read in at step S1. After the detection of the current throttle opening $\theta$ at step S2, the current throttle opening speed $d\theta/dt$ is calculated at step 3.

At step S4, a predetermined throttle opening $\theta_0$ corresponding to the current throttle opening speed $d\theta/dt$ is read out from a map, which opening $\theta_0$ is then compared at step S5 with the current throttle opening $\theta$. Only when the result of comparison at step S5 indicates that the current throttle opening $\theta$ has increased to the predetermined throttle opening $\theta_0$, an air pump drive signal is outputted at step S6.

As hereinbefore described, the accelerability agreeing with the degree of requirement for acceleration can be obtained when the pump operating load for the air pump 7 is controlled according to the actual degree of requirement for acceleration. However, in the embodiment shown in Figs. 5 to 9, the pump operating load for the air pump 7 is controlled according to the position of the automobile transmission, reference to which will now be made.

Figure 5:
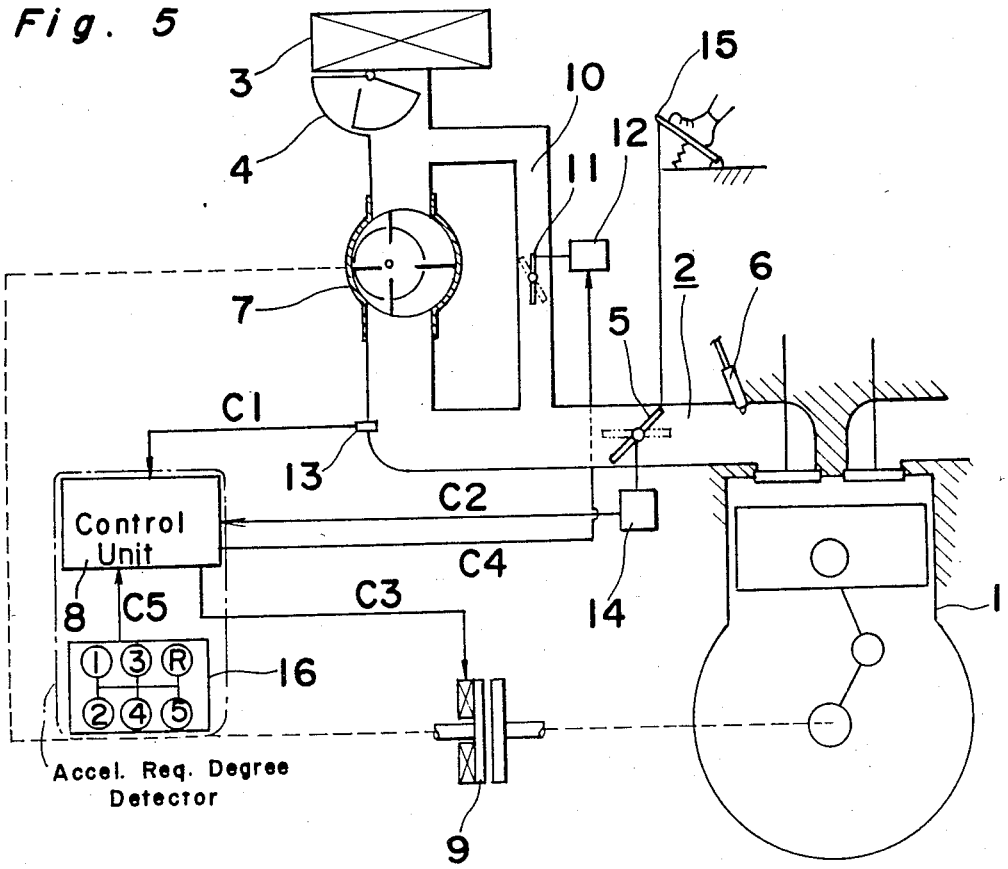
FIG. 5 is a schematic diagram similar to FIG. 1, showing the supercharger control according to another embodiment of the present invention.

As shown in FIG. 5, the control unit 8 connected with the electromagnetic clutch 9, the stepper motor 12, the load sensor 13 and the throttle sensor 14 as hereinbefore described in connection with the foregoing embodiment is additionally connected with a shaft switch 16 which applies to the control unit 8 a shift signal C5 indicative of the position of the automobile transmission. Thus, the control unit 8 shown in FIG. 5 is operable in response to the pressure signal C1, the throttle signal C2 and the shift signal C5 to apply the clutch signal C3 and the drive signal C4 to the electromagnetic clutch 9 and the stepper motor 12, respectively, thereby controlling the air pump 7 and the control valve 11 so that the mode of operation of the engine 1 can be switched between the supercharged and nonsupercharged modes according to the load imposed on the engine. In other words, the control unit 8 in the embodiment shown in FIG. 5 is so designed that the engine 1 can operate under the supercharged mode with the air pump 7 driven and with the control valve 11 closing the bypass passages 10 when an engine operating condition falls in a supercharged operating region (each operating region bound between the curve $L_0$, representative of the maximum output, and any one of the curves $L_1$, $L_2$, $L_3$, $L_4$ and $L_5$ which represent respective values of the pump operating load corresponding to gear positions of the transmission as shown in FIG. 8), but the engine 1 can operate under the nonsupercharged mode with the air pump held still and with the control valve 11 opening the by-pass passage 10 during the low load operating condition of the engine (represented by a region other than the regions described hereinabove with reference to FIG. 8).

Hereinafter, respective operating characteristics of the air pump 7 and the control valve 11 will be described in association with the position of the transmission (not shown), it being, however, to be noted that the shift switch 16 is of a design capable of generating the shift signal C5 indicative of a different gear position of the transmission.

Figure 6:
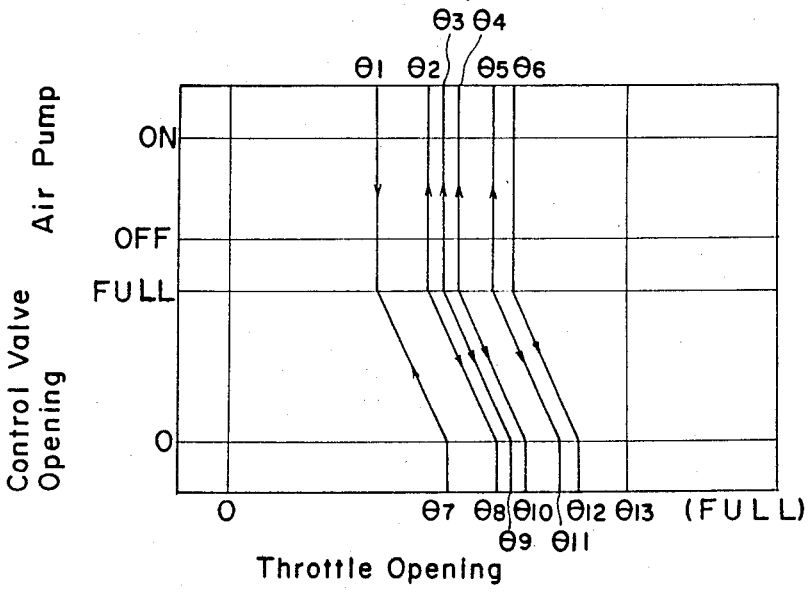
FIG. 6 is a graph showing the operating characteristics of the air pump and the control valve, respectively, show in timed relation to each other, which pump and valve are used in the supercharger control of FIG. 5.
Figure 7:
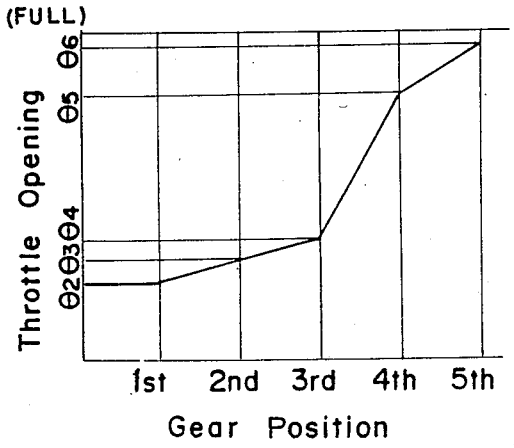
FIG. 7 is a graph showing change in pump operating load relative to the position of an automobile transmission.
Figure 8:
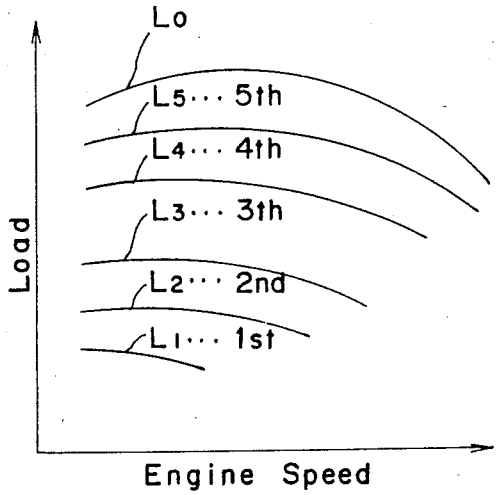
FIG. 8 is a graph showing change in torque with change in pump operating load relative to different gear positions of the transmission.

Referring to FIGS. 6 to 8, while the throttle opening corresponding to the load at which the air pump 7 is brought to a halt is fixed to a value $\theta_1$, the throttle opening corresponding to the pump operating load at which the air pump is brought into operation may take one of the five values corresponding respectively to the first to fifth gear positions of the automobile transmission. In other words, the throttle opening corresponding to the pump operating load will be a value $\theta_2$ ($\theta_2>\theta_1$) when the transmission is set in the first gear position; a value $\theta_3$ ($\theta_3>\theta_2$) when the transmission is set in the second gear position; a value $\theta_4$ ($\theta_4>\theta_3$) when the transmission is set in the third gear position; a value $\theta_5$ ($\theta_5>\theta_4$) when the transmission is set in the fourth gear position; and a value $\theta_6$ ($\theta_6>\theta_5$) when the transmission is set in the fifth gear position (over-top position), as shown in FIGS. 6 and 7. Of the throttle openings, the throttle openings $\theta_1$, $\theta_2$ and $\theta_3$ corresponding respectively to the first to third gear positions of the transmission are allocated a relatively small value so that the supercharging of the suction air can be effected at a relatively low load operating range, in view of the fact that the transmission is usually set in any one of these first to third gear positions when acceleration is desired. On the other hand, the throttle openings $\theta_5$ and $\theta_6$ corresponding respectively to the fourth and fifth gear positions are allocated a relatively great value so that no supercharging can take place at the low load operating range, in view of the fact that any one of the fourth and fifth gear positions is utilized during the constant speed drive.

Accordingly, as shown in FIG. 8, since the supercharging takes place at the lower load operating condition when the transmission is set in a low speed range, the output characteristic thereof can be improved with a smooth and powerful acceleration attained. On the other hand, since when the transmission is set in a high speed range, the air pump 7 is held still at the low load operating condition, the loss of output (the loss of the drive torque of the air pump 7) can be minimized and, at the same time, the output can be increased at a high load operating condition while the amount of fuel supplied is suppressed, thereby increasing the fuel efficiency (that is, thereby achieving an economical drive at reduced fuel consumption).

Moreover, since even though the transmission is set in the low speed range such as, for example, the first gear position, the air pump can be held still before the engine load (the throttle opening) attains the predetermined pump operating load, no supercharging takes place during a low speed, low load operating condition (that is, a low output running range) such as, for example, a low speed cruising and, therefore, the output can easily be adjusted, with the steerability consequently improved favorably.

In the embodiment now under discussion, regardless of the particular gear position in which the transmission is set, the pump operating load and the load at which the pump 7 is brought to a halt are differentiated from each other. Therefore, any possible surging of the air pump 7 can be effectively avoided.

With respect to the control valve 11 in the embodiment shown in FIGS. 5 to 9, as is the case with the air pump 7, the throttle opening corresponding to the engine load at which the control valve 11 starts opening the bypass passage 10 is fixed to a value $\theta_7$. However, the throttle opening corresponding to the engine load at which the control valve 11 starts closing the bypass passage 10 may take one of the five values according to the position of the transmission. In other words, the throttle opening corresponding to the load at which the control valve 11 starts closing the bypass passage 10 will be the value $\theta_2$ when the transmission is set in the first gear position; the value $\theta_3$ when the transmission is set in the second gear position; and value $\theta_4$ when the transmission is set in the third gear position; the value $\theta_5$ when the transmission is set in the fourth gear position; and the value $\theta_6$ when the transmission is set in the fifth gear position. That is, for a given gear position, the position at which the control valve 11 starts closing the bypass passage 10 is identical with the pump operating load for the air pump 7.

The control valve 11 starts closing the bypass passage 10 simultaneously with the start of operation of the air pump 7 and progressively closes the bypass passage 10 (that is, with the transmission set in the first gear position, the control valve 11 starts moving from the fully open position towards the closed position when the throttle opening is of the value $\theta_2$, and arrives at the closed position when the throttle opening is of a value $\theta_8$; with the transmission set in the second gear position, the control valve 11 starts moving from the fully open position towards the closed position when the throttle opening is of the value $\theta_3$, and arrives at the closed position when the throttle opening is of a value $\theta_9$; with the transmission set in the third gear position, the control valve 11 starts moving from the fully open position towards the closed position when the throttle opening is of the value $\theta_4$, and arrives at the closed position when the throttle opening is of a value $\theta_{10}$; with the transmission set in the fourth gear position, the control valve 11 starts moving from the fully open position towards the closed position when the throttle opening is of the value $\theta_5$, and arrives at the closed position when the throttle opening is of a value $\theta_9$; and with the transmission set in the fifth gear position, the control valve 11 starts moving from the fully open position towards the closed position when the throttle opening is of the value $\theta_6$, and arrives at the closed position when the throttle opening is of a value $\theta_{12}$). Therefore, immediately after the start of operation of the air pump 6, a portion of the suction air supercharged by the air pump 7 can be relieved through the bypass passage 10 back to the upstream side of the air pump 7, allowing the suction air to progressively increase in its pressure. On the other hand, since when the control valve 11 is to be moved towards the fully open position, the movement of the control valve 11 towards the fully open position is initiated at the throttle opening $\theta_7$ greater than the throttle opening $\theta_1$ at which the air pump 7 is brought to a halt, the effect of the supercharging performed by the air pump 7 diminishes with the opening of the control valve 11 with the suction air pressure gradually decreasing subsequent to the interruption of the air pump 7. Therefore, no abrupt change in suction air pressure occurs at the time the air pump 7 is brought into operation and also at the time the air pump 7 is brought to a halt, thereby avoiding the occurrence of undesirable shock resulting from abrupt change in torque.

The control of the air pump 7 rendered by the control unit 8 employed in the second embodiment of the present invention will now be described with reference to the flowchart of FIG. 9.

Figure 9:
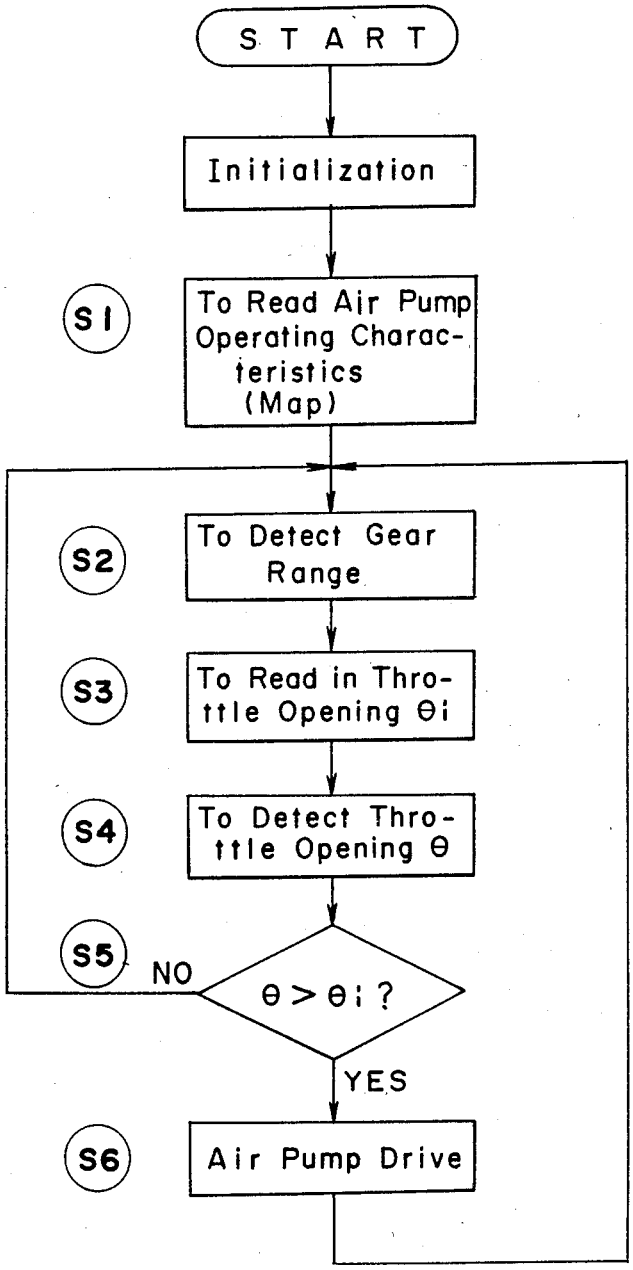
FIG. 9 is a flowchart showing the sequence of programmed control performed by the supercharger control shown in FIG. 5.

Referring to FIG. 9, and subsequent to the initialization, an operating characteristic of the air pump 7 is read in from a map shown in FIG. 8 at step S1. At the subsequent step S2, the current gear position is detected, and at step S3, the throttle opening $\theta i$ corresponding to the pump operating load at the time the transmission has been set in such gear position is read in. After the detection of the current throttle opening $\theta$ at step S4, the detected throttle opening $\theta$ and the throttle opening $\theta i$ are compared with each other at step S5, and only when it is indicated that the throttle opening $\theta$ is greater than the throttle opening $\theta i$, the air pump drive signal (clutch signal C4) is generated at step S6.

As hereinbefore described, when the pump operating load is controlled in dependence on the position of the transmission, the supercharging characteristic appropriate to each gear position can be obtained. In other words, when the transmission is set in the low speed range, for example, the first, second or third gear position (which is generally utilized during the drive in which the degree of requirement for acceleration is high), the air pump 7 is operated at the lower load region with the smooth and powerful acceleration achieved consequently. On the other hand, when the transmission is set in the high speed range, for example, the fourth and fifth gear positions for the constant speed drive (the gear position which is utilized during the drive wherein the degree of requirement for acceleration is small and the automobile is rather desired to be driven at a minimized fuel consumption), the air pump 7 can be brought into operation at the higher load than that achieved when the transmission is set in the low speed range and, therefore, the steerability with increased fuel efficiency can be achieved.

Although the present invention has been described in connection with the preferred embodiments thereof with reference to the accompanying drawings, it is to be noted that various changes and modifications are apparent to those skilled in the art. By way of example, as the means for detecting the degree of requirement for acceleration, the rapid opening of the throttle opening may be detected in terms of either a rapid reduction of the suction negative pressure in the intake passage downstream of the throttle valve, or a rapid increase of the air being sucked as detected by the air flowmeter.

Accordingly, such changes and modifications are to be understood as included within the scope of the present invention as defined by the appended claims, unless they depart therefrom.

What is claimed is:

1. A supercharger control in an automobile engine which comprises, in combination:

an intake passage for the introduction of air to the engine;

an air pump disposed in the intake passage for supercharging air flowing therethrough towards the engine;

a bypass passage bypassing only the air pump;

a control valve disposed in the bypass passage for controlling the effective cross-sectional area of the bypass passage;

a pump drive means;

means for causing the control valve to reduce the effective cross-sectional area of the bypass passage during the operation of the air pump;

a load detector for detecting, and generating a load signal indicative of, the load on the engine;

a control means responsive to the load signal, when the load on the engine increases, for activating the pump drive means to operate the air pump when the load on the engine exceeds a predetermined value;

means for detecting the degree of requirement for acceleration; and means operable in response to an output from the detecting means to vary a pump operating load, at which the air pump is to be operated, in such a way as to render the pump operating load to be lower in the case where the degree of requirement for acceleration is great than in the case where the degree of requirement for acceleration is small.

2. A control as claimed in claim 1, wherein the causing means reduces the effective cross-sectional area of the bypass passage to a minimum value a predetermined time after the operation of the air pump.

3. A control as claimed in claim 2, wherein the air pump is brought to a halt, when the load decreases, at a lower load than that at which the air pump is brought into operation.

4. A control as claimed in claim 3, wherein the control valve starts opening the bypass passage before the air pump is brought to a halt when the load decreases.

5. A control as claimed in claim 1, wherein the detecting means is a signal indicating that an accelerator pedal has been rapidly depressed.

6. A control as claimed in claim 5, wherein the degree of requirement for acceleration is detected in terms of the speed of opening of a throttle valve.

7. A control as claimed in claim 1, wherein the detecting means detects the gear stage of an automobile transmission.

8. A control as claimed in claim 1, wherein the pump drive means comprises means for connecting between the air pump and an output shaft of the engine and a clutch means disposed in the connecting means, and is operable to bring the air pump to a halt when the load is low, and wherein the control valve closes the bypass passage a predetermined time after the operation of the air pump, but opens the bypass passage before the air pump is brought to a halt.

9. A control as claimed in claim 8, wherein the detecting means generates a signal incident to the rapid depression of an accelerator pedal.

* * * * *